US005415001A

United States Patent [19]

Powars

[11] Patent Number: 5,415,001

[45] Date of Patent: May 16, 1995

[54] LIQUEFIED NATURAL GAS TRANSFER

[75] Inventor: Charles A. Powars, Palo Alto, Calif.

[73] Assignee: Gas Research Institute, Chicago, Ill.

[21] Appl. No.: 217,929

[22] Filed: Mar. 25, 1994

[51] Int. Cl.[6] ..... F17C 5/02

[52] U.S. Cl. ..... 62/50.2; 62/47.1

[58] Field of Search ..... 62/9, 50.2, 47.1

[56] References Cited

U.S. PATENT DOCUMENTS

| | | | |
|---|---|---|---|
| 2,842,942 | 7/1958 | Johnston et al. | 62/48.1 |
| 2,909,906 | 10/1959 | Bocquet et al. . | |
| 2,975,604 | 3/1961 | McMahon . | |
| 3,018,632 | 1/1962 | Keith . | |
| 3,473,343 | 10/1969 | Chamberlain . | |
| 3,780,534 | 12/1973 | Lofredo et al. . | |
| 3,803,858 | 4/1974 | Simon . | |
| 3,878,689 | 4/1975 | Greci et al. | 62/9 |
| 4,017,283 | 4/1977 | Witt | 62/47.1 |
| 4,100,759 | 7/1978 | Tyree, Jr. . | |
| 4,292,062 | 9/1981 | Dinulescu et al. . | |
| 4,334,902 | 6/1982 | Paradowski | 62/9 |
| 4,575,386 | 3/1986 | Hamers | 62/47.1 |
| 4,608,830 | 9/1986 | Peschka et al. . | |
| 5,107,906 | 4/1992 | Swenson et al. . | |
| 5,121,609 | 6/1992 | Cieslukowski . | |
| 5,211,021 | 5/1993 | Pierson . | |

*Primary Examiner*—Ronald C. Capossela
*Attorney, Agent, or Firm*—Speckman, Pauley & Fejer

[57] ABSTRACT

A process and apparatus for transfer of liquefied natural gas from a storage tank in subcooled condition using liquefied nitrogen to subcool the liquefied natural gas and nitrogen vapor formed by thermal transfer between the liquefied natural gas and liquefied nitrogen as pressurant to drive the transfer of subcooled liquefied natural gas. This invention provides a liquefied natural gas vehicle refueling station which utilizes nitrogen as a propellant and avoids venting natural gas to the atmosphere.

20 Claims, 1 Drawing Sheet

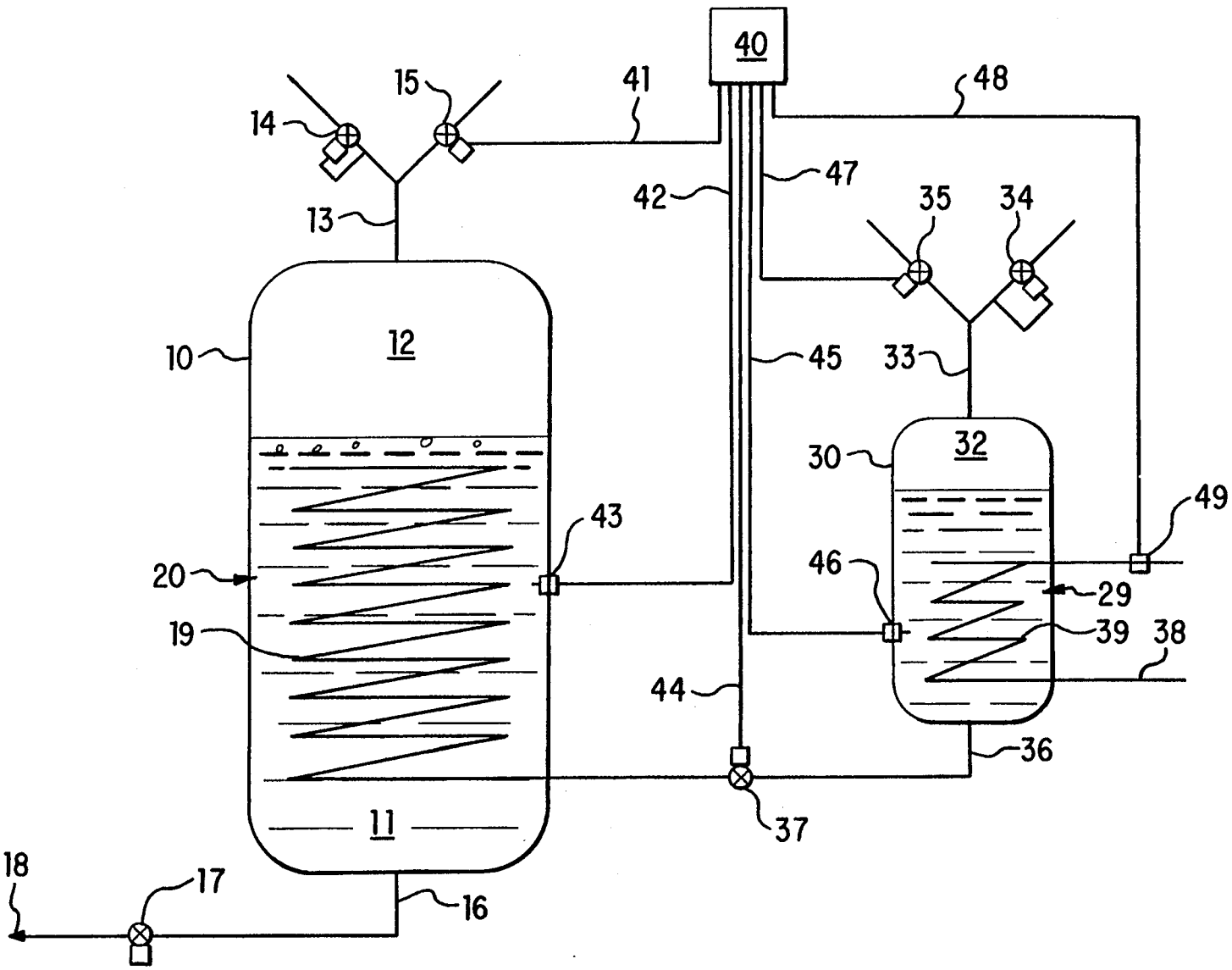
10
11
12
13
14
15
16
17
18
19
20
29
30
32
33
34
35
36
37
38
39
40
41
42
43
44
45
46
47
48
49

LIQUEFIED NATURAL GAS TRANSFER

BACKGROUND OF THE INVENTION

1. Field of the Invention

This invention relates to a process and apparatus for transfer of liquefied natural gas, such as for refueling vehicles with liquefied natural gas. The process provides direct transfer from a liquefied natural gas storage tank to a receiving tank, such as a vehicle tank, using liquid nitrogen to both subcool liquefied natural gas in the storage tank and act as a direct pressurant for transport of the liquefied natural gas from the storage tank to the receiving tank.

2. Description of Related Art

With the increased potential for use of liquefied natural gas (LNG) as a vehicle fuel, there is a need for easier and more efficient transfer of LNG, particularly for easy vehicle refueling. LNG is normally stored as a saturated liquid, that is, at its boiling point. Therefore, if any heat is transferred to the LNG during transfer, vaporization results. The boiling temperature of LNG decreases with pressure reduction resulting in vaporization of saturated LNG when transferred from a higher pressure tank to a lower pressure tank. Also, the density of LNG decreases as the pressure increases, resulting in the requirement of a larger tank to contain a given mass of saturated LNG when its pressure is increased.

Pump systems have been used in refueling to transfer LNG from a storage tank to a vehicle tank. In-line pumps, usually centrifugal, have been used for saturated LNG transfer with pump cavitation being a usual problem. In-line pump systems for vehicle refueling usually have a cool-down stage in which the initial LNG passed through the system is used to cool the pump and piping prior to initiation of the vehicle tank filling stage. During the cool-down stage LNG is vaporized, with the vaporized natural gas usually vented to the atmosphere. Pumps submerged in the LNG storage tank or in a separate sump tank result in less LNG vaporization, since they are maintained at the LNG storage tank temperature, but they are inconvenient with respect to hardware and accessibility. Submerged pumps also increase heat transfer to the storage LNG increasing the boil-off rate and during transfer vaporization still occurs as piping downstream of the pump is cooled.

Pressure transfer is used to transfer LNG from tank trucks to storage tanks by vaporization of LNG into the ullage to build up pressure to effect the liquid LNG transfer with the LNG vapor being vented upon completion of the transfer. The same general method can be used to transfer LNG from a refueling facility tank to a vehicle tank. Prior to each LNG vehicle refueling, pressure can be built up in the refueling facility primary LNG storage tank or in a smaller secondary tank which is supplied with LNG from the primary tank. In either case, considerable gas venting occurs when the pressure is relieved subsequent to a vehicle refueling cycle. Alternatively, pressure can be maintained continuously in the primary storage tank, in which case LNG becomes saturated at the higher pressure thereby increasing vaporization when transferred to a lower pressure tank. In all cases, vaporization also occurs as LNG initially cools the refueling line.

All of the above described LNG refueling systems result in significant LNG vaporization. It is undesirable to vent natural gas vapor since it contributes to global warming by depleting the ozone layer and, further, such venting results in less fuel being transferred to the vehicle tank. It is generally impractical to reliquefy the vaporized gas at the refueling site. Also, vaporization of LNG results in undesirable enrichment of the remaining LNG with heavier hydrocarbons rendering the LNG unacceptable for some engines.

Liquefaction of methane and natural gas is well known. Liquefaction of methane by use of initially liquid nitrogen in a refrigeration cycle is taught by U.S. Pat. No. 2,909,906. Liquefaction of natural gas by heat exchange with a nitrogen refrigeration cycle is taught by U.S. Pat. No. 3,780,534. Transport of methane as a liquid using liquefied nitrogen as a heat exchange material at each end of the transport, with liquid methane and liquid nitrogen being transported in opposite directions, is taught by U.S. Pat. Nos. 2,975,604 and 3,018,632.

Filling of high pressure gaseous fuel tanks rapidly by first pressurizing the tank with a predetermined quantity of cryogenic liquid, such as LNG or nitrogen, to achieve the desired pressure is taught by U.S. Pat. No. 5,211,021. Refueling compressed natural gas vehicle tanks by vaporizing LNG in a storage tank, on demand delivery basis, to high pressure natural gas vapor by a heat exchanger or external heat source is taught by U.S. Pat. No. 5,107,906.

Filling of vehicle refrigeration tanks with low pressure liquid carbon dioxide using carbon dioxide snow to condense carbon dioxide vapor created as a result of the transfer is taught by U.S. Pat. No. 4,100,759. Filling of liquid hydrogen vehicle fuel tanks wherein the delivery lines are cooled prior to connection with the vehicle by passage of liquid hydrogen is taught by U.S. Pat. No. 4,608,830. Avoidance of pressure build-up in vehicle LNG fuel tanks due to heat transfer over time when fuel is not being consumed and during delivery by cooling with liquid nitrogen through indirect heat transfer from a refrigeration cycle is taught by U.S. Pat. No. 4,292,062.

A liquid propellant, such as hydrogen, is maintained at desired pressure and temperature in a tank by pressurized gas, such as helium, from a second tank being discharged into the liquid in the propellant tank with the entire system being cooled by evaporation of the propellant and indirect heat exchange with both tanks is taught by U.S. Pat. No. 3,473,343. Transfer of liquid fuels, such as methane, by vaporizing a cryogenic liquid, such as helium, with the vapor being used as a pressurant is taught by U.S. Pat. No. 3,803,858. The vaporization taught by the '858 patent may be effected by indirect heat exchange with the liquid fuel or by discharge into the liquid fuel.

U.S. Pat. No. 5,121,609 teaches refueling LNG vehicles using a pressure building tank, separate from the LNG storage tank, wherein increased pressure is achieved by vaporization of LNG into the ullage to act as the pressurant for liquid transfer and decreased pressure is achieved by liquid nitrogen in indirect heat exchange through a heat exchanger to condense vaporized natural gas in the ullage. The '609 patent teaches that for deliveries of less than 10 gallons, a low quantity use line may be used which sub-cools LNG by passage through a heat exchanger in heat exchange with liquid nitrogen or suitable condensing agent or mechanism. The '609 patent teaches venting of natural gas, which forms by vaporization in the ullage of the vehicle tank, back to the ullage of the fueling station may be achieved by control of pressure in the fueling station and the vehicle fuel tank.

SUMMARY OF THE INVENTION

It is an object of this invention to reduce LNG vaporization during transfer from a storage tank to a use tank.

Another object of this invention is to avoid venting of natural gas vapor to the atmosphere upon fueling LNG fuel tanks.

Yet another object of this invention is to provide a LNG vehicle refueling station which utilizes nitrogen as a gaseous propellant and avoids venting natural gas to the atmosphere.

Still another object of this invention is to provide a fuel transfer system for LNG vehicles which can accommodate high fuel supply pressure requirements without employing a pump, substantially increases the time period between vehicle refueling and natural gas venting due to LNG vaporization, and enables the vehicle fuel tank to contain high-density subcooled LNG.

The above objects, and other advantages which will become apparent, are achieved by use of the process of this invention in which LNG is maintained in a storage tank at a pressure greater than atmospheric and subcooled, resulting in no LNG vapor in the tank ullage. Liquid nitrogen, maintained in a separate storage tank, is passed into the LNG storage tank for cooling of the LNG to the desired subcooled temperature with vaporization of the nitrogen into the LNG tank ullage from which the nitrogen may be vented to the atmosphere to maintain the desired pressure. At 14.7 psia, the boiling point of liquid nitrogen is −320° F., as compared to −259° F. for LNG, and the heat of vaporization of liquid nitrogen at 14.7 psia is 88 Btu/lbm, providing the opportunity to subcool the LNG by thermal exchange with liquid nitrogen. For refueling, additional liquid nitrogen is admitted to the LNG volume further subcooling the LNG and forming gaseous nitrogen which passes to the LNG tank ullage thereby increasing the pressure to above the desired refueling transfer pressure. Liquid nitrogen is used to subcool the LNG and produced gaseous nitrogen is used as the pressurant for LNG transfer. The refueling nozzle is then connected to the vehicle tank and the subcooled LNG passed to the vehicle tank due to the nitrogen pressurant in the LNG storage tank ullage. The subcooled LNG is introduced into the vehicle tank in such a manner that the subcooled LNG transfers some energy to condense natural gas vapor from the vehicle tank ullage, thereby avoiding the venting of natural gas vapor and instead utilizing it as useful fuel. When the vehicle tank is filled to the desired level with LNG, nitrogen is vented from the LNG storage tank ullage to restore the LNG storage pressure.

The process of this invention provides economical and rapid vehicle refueling with LNG without natural gas vapor venting and its concomitant detriment to the environment, economic loss and undesired enrichment of the LNG fuel with higher hydrocarbons. The process and apparatus of this invention provides a LNG fueling station which does not require any pumps.

The process of this invention for transfer of liquefied natural gas from a storage tank represents an improvement by passing liquid nitrogen in heat exchange relation with liquefied natural gas in its storage tank subcooling the liquefied natural gas to below the vaporization temperature of the liquefied natural gas in the storage tank and vaporizing liquid nitrogen by the heat exchange with the liquefied natural gas causing pressurization of nitrogen vapor in the ullage sufficient to act as a pressurant for transfer of the subcooled liquefied natural gas.

The process of this invention is especially well suited for refueling LNG vehicles with engine fuel injection systems requiring high fuel supply pressures of about 200 to about 4,000 psig. The current art is to use fuel pumps to produce the fuel supply pressures required for these LNG vehicles. According to the present invention, the subcooled LNG provided to the vehicle by a refueling station will enhance pump operation by reducing the likelihood of pump cavitation. Alternatively, the on-vehicle fuel system may utilize the process of this invention to eliminate the need for a pump and lengthen the vehicle tank hold-time. The hold-time before natural venting occurs would be determined by the on-vehicle liquid nitrogen storage capacity since the venting of nitrogen vapor does not create safety or environmental problems.

The process of this invention is also well suited to refuel vehicles with natural gas mixer carburetor systems which require lower fuel supply pressures of about 2 to about 200 psig. For those vehicles, the on-vehicle fuel tank would incorporate a pressure-building system to transfer heat to the LNG to raise its saturation pressure to the desired level, as is currently known to the art. Alternatively, the on-vehicle fuel system may utilize the process of this invention to lengthen the vehicle tank hold-time and increase the mass of LNG fuel containable in a given fuel tank volume.

BRIEF DESCRIPTION OF THE DRAWING

The above and further advantages of the process and apparatus of this invention will become evident upon reading of the detailed description and reference to the FIGURE which is a simplified, stylized schematic view of a vehicle refueling station according to one embodiment of this invention.

DESCRIPTION OF PREFERRED EMBODIMENTS

The FIGURE schematically shows a LNG vehicle refueling station according to one embodiment of this invention. While the invention will be described in detail with respect to refueling LNG fueled vehicles, it will be apparent that the apparatus and process is also suitable for any LNG transfer from a storage tank.

LNG storage tank 10 contains LNG 11 which has been liquefied by any suitable process known to the art and provided to LNG storage tank 10 by LNG supply means 20. Nitrogen vapor 12 occupies the tank ullage above the LNG and serves to adjust and maintain desired pressure within LNG storage tank 10 and as a pressurant for the transfer of LNG from storage tank 10. Outlet line 13 leads to valve 14 which is an overpressure valve to avoid undesirably high pressures in LNG storage tank 10 and valve 15 which is a pressure control valve to adjust and maintain desired pressure within LNG storage tank 10. LNG transfer line 16 transfers LNG from LNG storage tank 10 to the vehicle storage tank by connection through vehicle tank connector 18. The LNG flow in transfer line 16 is controlled by vehicle fill flow valve 17. LNG transfer line 16 may also provide for return flow of LNG to LNG storage tank 10 to enable cooling of transfer line 16 prior to transfer of LNG to the vehicle.

Liquid nitrogen storage tank 30 contains liquid nitrogen 31 which has been liquified by any process as is known to the art and provided to liquid nitrogen storage tank 30 by liquid nitrogen supply means 29. Nitrogen vapor 32 occupies the tank ullage above liquid nitrogen 31 and serves to adjust and maintain the desired pressure within liquid nitrogen storage tank 30 and serves as a pressurant for transfer and/or circulation of liquid nitrogen from liquid nitrogen storage tank 30 to LNG storage tank 10. Nitrogen outlet line 33 leads to valve 34 which is a nitrogen overpressure valve to avoid undesirably high pressures in liquid nitrogen storage tank 30 and valve 35 which is a nitrogen pressure control valve to adjust and maintain desired pressure within liquid nitrogen storage tank 30. Liquid nitrogen transfer line 36 transfers and/or circulates liquid nitrogen from liquid nitrogen storage tank 30 to LNG storage tank 10. The flow through liquid nitrogen transfer line 36 is controlled by liquid nitrogen control valve 37. Liquid nitrogen transfer line 36 passes liquid nitrogen to and through heat exchanger 19 which is in thermal exchange with LNG 11 in LNG storage tank 10. Gaseous nitrogen is formed by the liquid nitrogen absorbing heat from LNG 11, thereby subcooling LNG 11, and passes as nitrogen vapor from heat exchanger 19 to the ullage above LNG 11. An adjustable heat input means 38 provides any suitable thermal energy, such as electric, liquid, gas, and the like, to heater means 39 within liquid nitrogen storage tank 30. Heater means 39 raises the temperature of liquid nitrogen 31 to form nitrogen vapor 32 in the tank ullage above liquid nitrogen 31.

The system is controlled by controller means 40 which may be any electrical/electronic apparatus as known to the art capable of controlling as will be described. A suitable controller is a multi-tasking logic controller, such as manufactured by the Opto Company. Liquid nitrogen storage tank sensor means 46, capable of measuring temperature and pressure, transmits signals to controller means 40 through communication lines 45 corresponding to the temperature and pressure in liquid nitrogen storage tank 30. Heater control means 49 controls the heat output of heater means 39 by receipt of signals from controller means 40 through communication line 48, in response to signals received by controller means 40 from liquid nitrogen storage tank temperature and pressure sensor means 46. Nitrogen pressure control valve 35 is controlled by signals received through communication line 47 from controller means 40, in response to pressure measured by liquid nitrogen storage tank temperature and pressure sensor means 46, to obtain and maintain the desired pressure in liquid nitrogen storage tank 30. LNG storage tank sensor means 43, capable of measuring temperature and pressure, transmits signals to controller means 40 through communication lines 42 corresponding to the temperature and pressure in LNG storage tank 10. Pressure control valve 15 is controlled by signals received through communication line 41 from controller means 40, in response to pressure measured by LNG storage tank temperature and pressure sensor means 43, to obtain and maintain the desired pressure in LNG storage tank 10. Liquid nitrogen transfer valve 37 is controlled by signals received through communication line 44 from controller means 40.

In the storage mode, it is desired that the pressure in LNG storage tank be maintained at slightly above atmospheric pressure, up to about 20 psia being suitable, and the LNG be maintained at a subcooled temperature, about 10° to about 60° F., preferably about 15° to about 40° F., below its boiling point at the LNG storage tank pressure. The subcooling of the stored LNG results in substantially no vaporized natural gas in the LNG storage tank ullage. Both the temperature and pressure in the LNG storage tank is controlled by flow of liquid nitrogen from the nitrogen storage tank. The temperature of the LNG may be lowered by passage of liquid nitrogen, having a lower boiling point than LNG, through heat exchanger 19 in the nitrogen storage tank. The pressure in the LNG storage tank may be increased by flow of nitrogen gas, obtained from vaporization of liquid nitrogen by thermal exchange with LNG, subcooling the LNG, and may be decreased by venting nitrogen gas from the LNG storage tank ullage through nitrogen pressure control valve 15. Saturated liquid nitrogen is stored in liquid nitrogen storage tank 30 at a higher pressure than maintained in LNG storage tank 10, about 20 to about 100 psia, preferably about 30 to about 60 psia. The pressure is maintained in liquid nitrogen storage tank 30 by setting controller 40 for the desired pressure which is decreased by venting nitrogen gas through nitrogen pressure control valve 35 and increased by adding heat to heater means 39 to vaporize liquid nitrogen to the tank ullage increasing the pressure. When an upper setpoint temperature for LNG storage is sensed by controller 40 receiving signals from LNG tank temperature sensor 43, controller 40 signals liquid nitrogen control valve 37 opening flow of liquid nitrogen to heat exchanger 19 subcooling LNG 11 to a subcooled temperature preset in controller 40. The preset subcooled temperature of the LNG is sensed by sensor 43 and signalled to controller 40 which closes the flow of liquid nitrogen through nitrogen control valve 37. Increase in pressure due to nitrogen gas passing to the ullage of LNG storage tank 10 is sensed by sensor means 43 and signalled to controller 40 which opens nitrogen pressure control valve 15 to reduce the pressure in LNG storage tank 10 to a pressure preset in controller 40.

For the refueling mode, the LNG storage tank pressure is reset in controller 40 to a higher than storage pressure, suitably about 30 to about 90 psia, preferably about 50 to about 70 psia, above the refueling transfer pressure. The controller opens liquid nitrogen control valve 37 passing liquid nitrogen through heat exchanger 19 vaporizing the nitrogen and further subcooling the LNG and passes nitrogen vapor to the LNG tank ullage increasing the LNG storage tank pressure. Pressure in the liquid nitrogen tank is maintained, as described above, by heater means 19 vaporizing liquid nitrogen to maintain the required saturated nitrogen vapor pressure in the tank ullage. Refueling nozzle 18 is connected to the vehicle refueling coupling and subcooled LNG passes to the vehicle tank. It is preferred to spray the incoming subcooled LNG over natural gas vapor in the vehicle tank ullage so that the subcooled LNG will surrender some of its energy to condense the natural gas vapor increasing the LNG available as fuel and prevent venting of natural gas vapors to the atmosphere. The highly subcooled LNG delivered according to the present invention is particularly effective in condensing the natural gas vapor in the ullage. The subcooled LNG in the vehicle storage tank will also increase the vehicle tank hold time. When the vehicle tank is filled to the desired level, refueling is terminated by closing vehicle fill flow valve 17 and liquid nitrogen control valve 37. LNG storage tank 10 may be restored to its desired storage mode pressure by opening nitrogen pressure control valve 15 to vent nitrogen vapor from the tank ullage. Liquid nitrogen storage tank 30 may be restored to its desired storage mode pressure in similar fashion be opening nitrogen pressure control valve 33 to vent nitrogen vapor from its ullage.

In another preferred embodiment, subcooled LNG may be recirculated through LNG transfer line 16 and back to LNG storage tank 10 prior to refueling to cool the refueling hardware. In this case, any vaporized LNG is recondensed by the subcooled LNG.

The apparatus of this invention may be constructed of materials and designs known to the art as suitable for the temperatures and pressures required, as described above. The LNG and liquefied nitrogen storage tanks and fluid transfer lines are vacuum jacketed, or otherwise suitably insulated, as is known in the art for cryogenic equipment design. Heat exchangers may be constructed of any suitable material and may be of any configuration as will be apparent to one skilled in the art upon reading the above description of the invention. Suitable control valves and controller means are also readily available to one skilled in the art upon reading the above description of the invention.

The apparatus and process of this invention provide delivery of LNG from a storage tank as a subcooled liquid and, therefore, no boiling of LNG occurs to form natural gas vapor which requires venting, which causes undesired enrichment of the LNG with higher molecular weight hydrocarbons, and which represents an economic loss.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In a process for transfer of liquefied natural gas from a storage tank, the improvement comprising; passing liquid nitrogen in heat exchange relation with said liquefied natural gas in said storage tank subcooling said liquefied natural gas to about 10° to about 60° F. below the boiling temperature of said liquefied natural gas in said storage tank, and vaporizing liquid nitrogen by said heat exchange with said liquefied natural gas causing pressurization of nitrogen vapor in the ullage of said storage tank sufficient to act as a pressurant for said transfer in a transfer mode.

2. In a process for transfer according to claim 1 wherein said liquefied natural gas in said storage tank is subcooled to about 15° to about 40° F. below the boiling temperature of said liquefied natural gas in said storage tank.

3. In a process for transfer according to claim 1 wherein the pressure in said storage tank is maintained at above atmospheric to about 20 psia in a storage mode.

4. In a process for transfer according to claim 1 wherein the pressure in said storage tank is maintained at about 30 to about 90 psia above desired transfer pressure in said transfer mode.

5. In a process for transfer according to claim 1 wherein the pressure in said storage tank is maintained at about 50 to about 70 psia above desired transfer pressure in said transfer mode.

6. In a process for transfer according to claim 1 wherein said liquefied natural gas storage tank pressure is reduced by venting said nitrogen vapor from said ullage.

7. In a process for transfer according to claim 1 additionally comprising circulating said subcooled liquefied natural gas through a transfer line and back to said storage tank prior to said transfer.

8. A process for transfer of liquefied natural gas from a liquefied natural gas storage tank comprising: passing liquid nitrogen in heat exchange relation with said liquefied natural gas in said liquefied natural gas storage tank producing subcooled liquefied natural gas; vaporizing at least a portion of said liquid nitrogen by said heat exchange with said liquefied natural gas sufficient to cause pressurization of substantially nitrogen vapor in the ullage of said liquefied natural gas storage tank; and passing said subcooled liquefied natural gas from said liquefied natural gas storage tank in a delivery mode driven by said pressurization of said substantially nitrogen vapor in the ullage of said liquefied natural gas storage tank.

9. A process according to claim 8 wherein said subcooled liquefied natural gas is about 10° to about 60° F. below the boiling temperature of said liquefied natural gas in said liquefied natural gas storage tank.

10. A process according to claim 9 wherein said temperature is about 15° to about 40° F.

11. A process according to claim 8 wherein said pressurization in said delivery mode is about 30 to about 90 psia above desired transfer pressure.

12. A process according to claim 11 wherein said pressurization is about 50 to about 70 psia above desired transfer pressure.

13. A process according to claim 8 further comprising: venting said substantially nitrogen vapor from said ullage of said liquefied natural gas storage tank following said passing said subcooled liquefied natural gas from said liquefied natural gas storage tank so as to reduce pressure in said liquefied natural gas storage tank to a pressure above atmospheric up to about 20 psia for a storage mode.

14. A process according to claim 8 further comprising: storing saturated liquid nitrogen in a liquid nitrogen storage tank; and vaporizing a portion of said saturated liquid nitrogen sufficient to maintain saturated nitrogen vapor in the ullage of said liquid nitrogen storage tank under pressure sufficient to pass a portion of said liquid nitrogen to said heat exchange relation with said liquefied natural gas.

15. A process according to claim 14 further comprising: passing said subcooled liquefied natural gas to a vehicle liquefied natural gas tank; and introducing said subcooled natural gas into the ullage of said vehicle liquefied natural gas tank condensing at least a portion of any vaporized natural gas in said ullage of said vehicle liquefied natural gas tank.

16. A process according to claim 14 wherein said subcooled liquefied natural gas is about 10° to about 60° F. below the boiling temperature of said liquefied natural gas in said liquefied natural gas storage tank.

17. A process according to claim 14 further comprising: venting said substantially nitrogen vapor from said ullage of said liquefied natural gas storage tank following said passing said subcooled liquefied natural gas from said liquefied natural gas storage tank so as to reduce pressure in said liquefied natural gas storage tank to a pressure above atmospheric up to about 20 psia for a storage mode.

18. A process according to claim 14 further comprising: passing said subcooled liquefied natural gas to a vehicle liquefied natural gas tank; introducing said subcooled natural gas into the ullage of said vehicle liquefied natural gas tank condensing at least a portion of any vaporized natural gas in said ullage of said vehicle liquefied natural gas tank; maintaining said subcooled liquefied natural gas at about 10° to about 60° F. below the boiling temperature of said liquefied natural gas in said liquefied natural gas storage tank; and venting said substantially nitrogen vapor from said ullage of said liquefied natural gas storage tank following said passing said subcooled liquefied natural gas from said liquefied natural gas storage tank so as to reduce pressure in said liquefied natural gas storage tank to above atmospheric to about 20 psia for a storage mode.

19. A process according to claim 14 wherein said liquefied natural gas storage tank and said liquid nitrogen storage tank are on-board a vehicle to supply vehicle fuel supply pressures and lengthen said vehicle tank hold-time.

20. An apparatus for transfer of liquefied natural gas from a storage tank comprising: a liquefied natural gas storage tank having liquefied natural gas therein; a pressure control valve in gaseous communication with the ullage of said liquefied natural gas storage tank; a liquefied natural gas transfer line having one end in liquid communication with said liquefied natural gas; a flow control valve in said liquefied natural gas transfer line; flow through heat exchanger means in thermal exchange relation with said liquefied natural gas, said flow through heat exchanger means having a downstream open end; liquefied natural gas temperature and pressure sensing means; a liquefied nitrogen storage tank having liquefied nitrogen therein; a nitrogen pressure control valve in gaseous communication with the ullage of said liquefied nitrogen storage tank; a liquefied nitrogen transfer line having an upstream end in liquid communication with said liquefied nitrogen and a downstream end in liquid communication with the upstream end of said flow through heat exchanger means; a flow control valve in said liquefied nitrogen transfer line; adjustable heater means in thermal exchange relation with said liquefied nitrogen; and liquefied nitrogen temperature and pressure sensing means.

* * * * *